US006648171B2

(12) United States Patent
Rink, Jr.

(10) Patent No.: US 6,648,171 B2
(45) Date of Patent: Nov. 18, 2003

(54) STACKED ASSEMBLY OF DISPOSABLE RAIN PROTECTION DEVICES HAVING A REINFORCED HOLDER

(76) Inventor: Joseph Bernard Rink, Jr., 4609 Beau Lac La., Metairie, LA (US) 70002

( * ) Notice: Subject to any disclaimer, the term of this patent is extended or adjusted under 35 U.S.C. 154(b) by 65 days.

(21) Appl. No.: 10/109,012

(22) Filed: Mar. 28, 2002

(65) Prior Publication Data

US 2002/0104149 A1 Aug. 8, 2002

Related U.S. Application Data

(63) Continuation of application No. 09/484,104, filed on Jan. 14, 2000, now Pat. No. 6,341,381, and a continuation-in-part of application No. 10/039,379, filed on Jan. 2, 2002, now Pat. No. 6,454,125, and a continuation-in-part of application No. 09/548,488, filed on Apr. 13, 2000, now abandoned, and a continuation-in-part of application No. 09/495,086, filed on Jan. 31, 2000, now Pat. No. 6,389,723.

(51) Int. Cl.[7] ..... B65H 3/58
(52) U.S. Cl. ..... 221/26; 206/554
(58) Field of Search ..... 221/26, 27, 45, 221/282, 283; 206/554, 526, 494, 806; 248/304; 40/642.02

(56) References Cited

U.S. PATENT DOCUMENTS

| | | | |
|---|---|---|---|
| 191,645 | A | 6/1877 | Breese |
| 1,398,165 | A | 11/1921 | Whiteside |
| 1,618,297 | A | 2/1927 | Reinhold |
| 2,191,589 | A | 2/1940 | Sacks |
| 2,421,934 | A | 6/1947 | Goltieri |
| 2,447,561 | A | 8/1948 | Brenner |
| 2,484,269 | A | 10/1949 | Carlson |
| 2,694,812 | A | 11/1954 | Neuburger |
| 2,711,538 | A | 6/1955 | De Cordero |
| 2,740,127 | A | 4/1956 | Whitehead |
| 2,903,705 | A | 9/1959 | Price |
| 3,014,221 | A | 12/1961 | Brunetto |
| 3,064,267 | A | 11/1962 | Tullos |
| 3,111,677 | A | 11/1963 | Artzt |
| 3,252,236 | A | 5/1966 | Davis |
| 3,285,406 | A | 11/1966 | Winesett |
| 3,318,444 | A | 5/1967 | Weicher et al. |
| 3,466,665 | A | 9/1969 | Mooney |
| 3,556,115 | A | 1/1971 | Benson |
| 3,946,443 | A | 3/1976 | Knight |
| 3,951,160 | A | 4/1976 | Nitu |
| 3,978,601 | A | 9/1976 | Catron |
| 4,055,852 | A | 11/1977 | Wallace |
| 4,218,777 | A | 8/1980 | Munnikhuysen |
| 4,313,229 | A | 2/1982 | Villafane |
| 4,502,599 | A | 3/1985 | Perecman |
| 4,537,330 | A | 8/1985 | Gelbard |
| 4,557,384 | A | 12/1985 | Membrino |
| 4,781,474 | A | 11/1988 | Sengewald |
| 4,887,316 | A | 12/1989 | Morandini |

(List continued on next page.)

*Primary Examiner*—Kenneth W. Noland
(74) *Attorney, Agent, or Firm*—Wyatt, Tarrant & Combs, LLP

(57) ABSTRACT

A stacked assembly of disposable rain protection devices having a reinforced holder for displaying and dispensing the disposable rain protection devices from a bracket member of a display stand. The display holder is formed from a piece of cardboard folded upward along an upward fold and downward along a pair of downward folds to thereby form a pair of opposing display holder flaps and an integral reinforcement member comprising a pair of opposing reinforcement member flaps. The reinforcement member flaps are fixedly attached to one another and are sandwiched between the display holder flaps and depend downward from an upper portion of the opposing display holder flaps. The disposable rain protection devices are stacked together, and are sandwiched between the opposing display holder flaps such that a disposable rain protection device can be detached from the holder by pulling the rain protection device in order to break a frangible perforation.

21 Claims, 8 Drawing Sheets

U.S. PATENT DOCUMENTS 5,099,526 A 3/1992 Baena
5,119,968 A 6/1992 Palmer
5,287,560 A 2/1994 Garcia
5,683,003 A 11/1997 Gebka
5,788,080 A 8/1998 Sill et al.
5,832,538 A 11/1998 Williams
5,864,887 A 2/1999 Kozawa
6,065,233 A 5/2000 Rink
6,142,302 A 11/2000 Requena
6,389,723 B1 * 5/2002 Rink, Jr. ..... 40/642.02

* cited by examiner

STACKED ASSEMBLY OF DISPOSABLE RAIN PROTECTION DEVICES HAVING A REINFORCED HOLDER

CROSS REFERENCE TO RELATED APPLICATIONS

This application is a continuation-in-part of application Ser. No. 09/484,104, filed Jan. 14, 2000, now U.S. Pat. No. 6,341,381; application Ser. No. 09/495,086, filed Jan. 31, 2000, which is now U.S. Pat. No. 6,389,723; application Ser. No. 09/548,488, filed Apr. 13, 2000, which is now abandoned; and application Ser. No. 10/039,379, filed Jan. 2, 2002, which is now U.S. Pat. No. 6,454,125.

STATEMENT REGARDING FEDERALLY SPONSORED RESEARCH OR DEVELOPMENT

Not applicable

REFERENCE TO A MICROFICHE APPENDIX

Not applicable

FIELD OF THE INVENTION

The present invention relates to displaying and dispensing disposable rain protection devices, such as rain hoods and bags for storing wet umbrellas, and more particularly to a reinforced display holder for use in displaying and dispensing such items.

BACKGROUND OF THE INVENTION

The inventor has previously invented disposable receptacles for umbrellas, along with devices for the display and dispensing of such receptacles. The inventor has further developed a market for such devices. In U.S. patent application Ser. No. 09/484,104, the inventor recently disclosed a novel design for a disposable rain hood for display and dispensing from stands (see FIGS. 1–4). In U.S. patent application Ser. No. 09/548,488, the inventor recently disclosed a novel design for a reinforced holder for disposable rain hoods and other rain protection devices. The present invention improves on the inventions of patent application Ser. No. 09/484,104 and patent application Ser. No. 09/548488 as well as the inventor's existing design for disposable receptacles for umbrellas, and is directed generally to overcoming the following problems associated with the prior art. Additionally, the present invention can be used with the display stand disclosed in the inventor's recently filed U.S. patent application Ser. No. 09/495,086 (FIGS. 9–10).

New umbrellas are generally sold with a storage bag. The storage bag is usually made of a material similar to the collapsible cover of the umbrella, such as a nylon weave, and is sized and configured to hold the umbrella when the umbrella has been collapsed and is not in use. If the umbrella is wet from a recent rain shower, placing the umbrella in the storage bag will keep the rain water from dripping off of the umbrella and wetting the floor, where the water may dirty the floor or cause a passerby to slip. However, because the owner of an umbrella seldom knows when he or she will need to use the umbrella, the owner will frequently, and often haphazardly, place the umbrella in a place where it will be available at a moment's notice, such as in an office desk, a purse, a brief case, the floor of a closet, the trunk of an automobile, or even the floor of an automobile. After a period of storage and use of the umbrella, the storage bag often becomes lost, and in any event is usually unavailable when needed following use of the umbrella during a rain shower.

As mentioned above, the inventor has developed an apparatus and method for supplying disposable receptacles for umbrellas. The disposable receptacles consist of an elongated plastic bag that is designed to fit over a collapsed umbrella. The disposable receptacles keep wet umbrellas from dripping water, and thus prevent slips, soiling of floors and carpets, and other consequences of tracking rain water into a public building. A stand is provided for displaying and dispensing the disposable receptacles. The stand consists generally of a base, a pole extending substantially vertically upward from the base, and a bracket member for holding a plurality of disposable receptacles for umbrellas. (See FIGS. 3 and 4) Such display stands and disposable receptacles have been successful on the market, and are used particularly in public buildings that have heavy foot traffic. However, the disposable receptacles are useful only for individuals who happen to have umbrellas with them. There is thus a need for a disposable receptacle that can be conveniently displayed on such stands, and thus can be dispensed as needed during rain showers.

Rain protection garments, such as rain coats, rain hoods, ponchos, and the like, are used to keep individuals dry during rain showers. Such garments are typically designed for repeated use, and are therefore made of durable, rain impermeable materials such as canvas, oilcloth, nylon and the like. Disposable rain hoods and ponchos are also available. Disposable rain hoods are typically made of plastic sheets. Disposable rain hoods find particular uses at outdoor events, such as festivals and sporting events, where a sudden, unexpected shower may catch individuals without umbrellas or rain protection garments. In such circumstances, disposable rain hoods can be sold at low cost or donated to individuals attending the event, and can then be discarded when no longer needed. As mentioned above, in U.S. patent application Ser. No. 09/484,104, the inventor recently disclosed a novel design for a disposable rain hood for display and dispensing from stands (see FIGS. 1–4).

The above disposable rain protection devices are typically distributed free of charge to patrons of public buildings and businesses. As a result, maintaining low costs of manufacture is important.

One particular problem that the inventor has experienced with the foregoing designs for disposable rain protection devices is that the display holder that holds the disposable rain protection devices may tear under the repeated stress of pulling disposable rain protection devices in order to separate the devices from the display holder. A design for existing display holders is shown as item 90 in FIG. 4. The display holder generally comprises a piece of paperboard, cardboard, other type of cardboard that is folded to form opposing flaps 96A and 96B. A stack of disposable rain protection devices 1 is attached to a lower end of the opposing flaps 96A, 96B. An aperture 92 passes through the opposing flaps 96A, 96B (FIGS. 3 and 4). As shown in FIG. 4, the display holder can be suspended from a display stand 200 by passing a prong 216 of the display stand through the aperture of the display holder 90.

Because of cost considerations in providing large volumes of disposable rain protection devices, the display holders 90 of such devices are typically made of paperboard, cardstock or other types of cardboard. Cardboard materials provide an optimal balance between tear resistance and economics of manufacture. However, cardboard materials, while generally tear resistant under the forces ordinarily encountered with this invention, are subject to tearing under certain circumstances, such as when excessive force is applied (for example, if a disposable rain protection devices does not tear away properly), after repeated stress from multiple pulls, or if the cardboard becomes wet. When a passerby pulls an individual disposable rain protection device in order to separate it from the display holder 90, stress is created between the prong 216 of the display stand 200 and the aperture 92. With repeated stress, such as when a dozen or more disposable rain protection devices are pulled and separated from the display holder 90, the display holder may tear at the aperture 92. Once a tear starts, it is likely to become larger. Continued removal of disposable rain protection devices may tear the aperture 92 to the point that the display holder, along with the disposable rain protection devices, falls off of the stand. Even in situations where the display holder does not tear entirely off of the display stand, tears may be unsightly, particularly to proprietors of businesses and public buildings.

The present invention is directed to overcoming the aforementioned problems without sacrificing the economic considerations that have helped make the inventor's disposable rain protection devices a success.

OBJECTS AND SUMMARY OF THE INVENTION

It is an object of the invention to provide an improved means for displaying and dispensing disposable rain protection devices, such as receptacles for umbrellas and rain hoods.

It is another object of the invention to provide a reinforced display holder for displaying and dispensing disposable rain protection devices that is resistant to tearing.

It is yet another object of the invention to provide a reinforced display holder for displaying and dispensing disposable rain protection devices that is economical to manufacture, and therefore can be distributed free of charge or at low cost to the general public.

These and other objects and advantages of the invention shall become apparent from the following general and preferred description of the invention.

Accordingly, a stacked assembly of disposable rain protection devices having a reinforced holder for displaying and dispensing disposable rain protection devices from a bracket member of a display stand is provided comprising a display holder formed from a piece of cardboard folded upward along an upward fold and downward along a pair of downward folds to thereby form a pair of opposing display holder flaps and an integral reinforcement member comprising a pair of opposing reinforcement member flaps. Preferably, the reinforcement member flaps are fixedly attached to one another and are sandwiched between the display holder flaps and depend downward from an upper portion of the opposing display holder flaps. The display holder flaps and the reinforcement member flaps preferably have at least one aperture sized to receive the bracket member of the display stand to permit the suspension of disposable rain protection devices from the display stand via the display holder. The disposable rain protection devices comprise a suspension portion extending from an edge and connected to the edge by a frangible perforation. Preferably, the devices are stacked, attached to one another by a fastening means passing through the suspension portions, and sandwiched between the lower portion of the opposing display holder flaps such that a disposable rain protection device may be detached by pulling the device and breaking the frangible perforation.

In one preferred embodiment, the plurality of disposable rain protection devices are disposable receptacles for umbrellas. Each disposable receptacle for umbrellas comprises an elongated bag having an open end for receiving a wet umbrella and a closed end for preventing water from the wet umbrella from leaking from the receptacle. The disposable receptacles for umbrellas are preferably attached to the display holder via a suspension portion, the suspension portion being detachably connected to the open end of the elongated bag by a frangible perforation, such that a selected disposable receptacle may be selectively detached from the suspension portion and the display holder by pulling the disposable receptacle relative to the display holder to thereby break the frangible perforation.

In another preferred embodiment, the plurality of disposable rain protection devices are disposable rain hoods. The disposable rain hoods comprise a pair of opposing flaps, the flaps attached to one another substantially along respective upper edges thereof, the flaps further attached to one another substantially along respective rear edges thereof, the upper and rear edge attachments providing a rain-impermeable barrier along the upper and the rear edges of the disposable rain hood, and the disposable rain hood having a substantially open front edge and a substantially open lower edge for receiving a head and torso of a user of the disposable rain hood. A head stop is preferably provided for properly positioning the head of a user in the disposable rain hood. The head stop further attaches the respective opposing flaps to one another. The head stop extends downward substantially from the sealed upper edge of the disposable hood and extends substantially parallel to an upper portion of the sealed rear edge. The head stop is also preferably positioned a sufficient distance from the open front edge of the disposable rain hood to thereby permit the head stop to function as a rear barrier for a back portion of the head of the user while the hood simultaneously shields the head of the user from rain. Each of the opposing flaps of the disposable rain hood are preferably provided with at least one hole. The hole is preferably positioned substantially along the forward edge, so as to permit the forward edges of the disposable rain hood to be selectively held together either by fingers of the user or by a tie passing through the holes to thereby secure the hood on the user. The disposable rain hoods are preferably attached to the display holder via a suspension portion, the suspension portion detachably connected to the lower edge of the flaps of the disposable rain hood by a frangible perforation, such that a selected disposable rain hood may be selectively detached from the suspension portion and the display holder by pulling the disposable hood relative to the display holder to thereby break the frangible perforation.

Methods of constructing and displaying the foregoing reinforced display holder and associated disposable rain protection devices also provided.

PREFERRED EMBODIMENTS OF THE INVENTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 6:
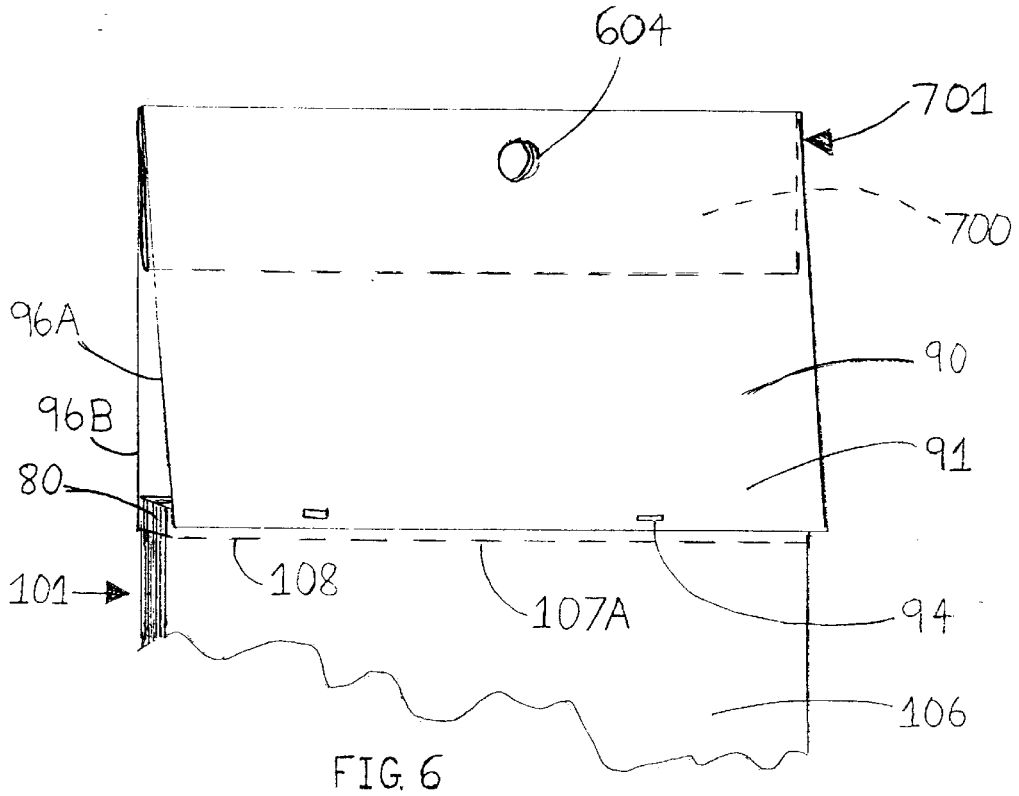
FIG. 6 is a front view of one preferred embodiment of a reinforced receptacle holder for disposable umbrellas bags, showing a phantom-view of a reinforcement member disposed between opposing flaps of the receptacle holder.

FIG. 6 shows a preferred embodiment of a front view of a reinforced holder 701 for displaying and dispensing disposable rain protection devices from a bracket member of a display stand. The term "disposable rain protection devices" as used herein refers to two particular types of devices, both of which are explained in further detail below: (1) disposable receptacles for umbrellas 106 (See FIGS. 6 and 10); and (2) disposable rain hoods 1 (see FIGS. 1–4, 8).

As shown in FIG. 6, the reinforced holder 701 of the invention comprises, generally, a display holder 90, a reinforcement member 700 (shown partially in phantom lines), an aperture 604 passing through both the display holder 90 and the reinforcement member 700, and a plurality of disposable rain protection devices 106 removably attached to a lower portion 91 of the display holder 90.

Figure 7:
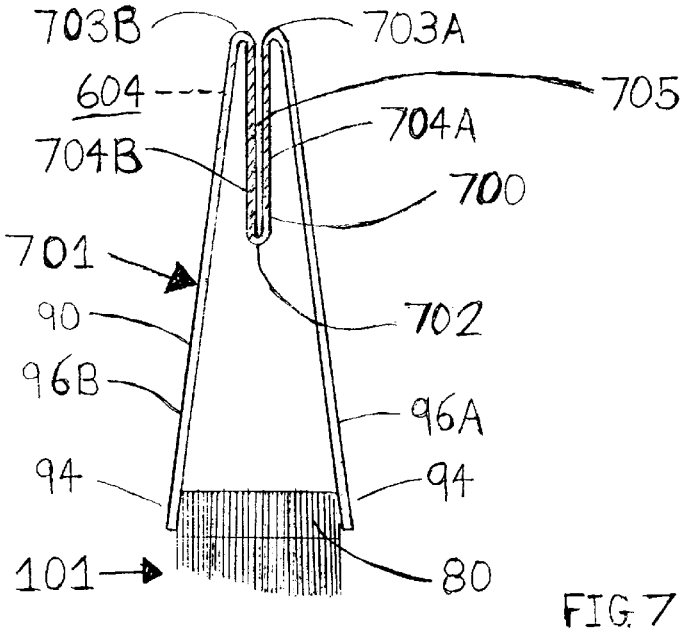
FIG. 7 is a side view of the reinforced receptacle holder of FIG. 6.

As shown most clearly in FIG. 7, the display holder 90 has a pair of opposing flaps 96A, 96B. In a preferred embodiment, the display holder 90 is made from a sheet of cardstock, paperboard, or other type of card board, and the opposing flaps 96A, 96B are formed by folding the display holder 90 downward along downward folds 703A, 703B.

The reinforcement member 700 forms an integral part of the display holder 90 and is constructed of similar material. The reinforcement member 700 comprises a pair of opposing flaps 704A, 704B and is formed by folding the display holder 90 upward along upward fold 702, preferably into substantially equal halves. The reinforcement member 700 is sandwiched between the opposing flaps 96A, 96B of the display holder, as shown most clearly in FIGS. 7 and 8. In the embodiment shown in FIG. 6, the reinforcement member 700 is rectangular and is substantially the same length as the display holder 90.

Figure 8:
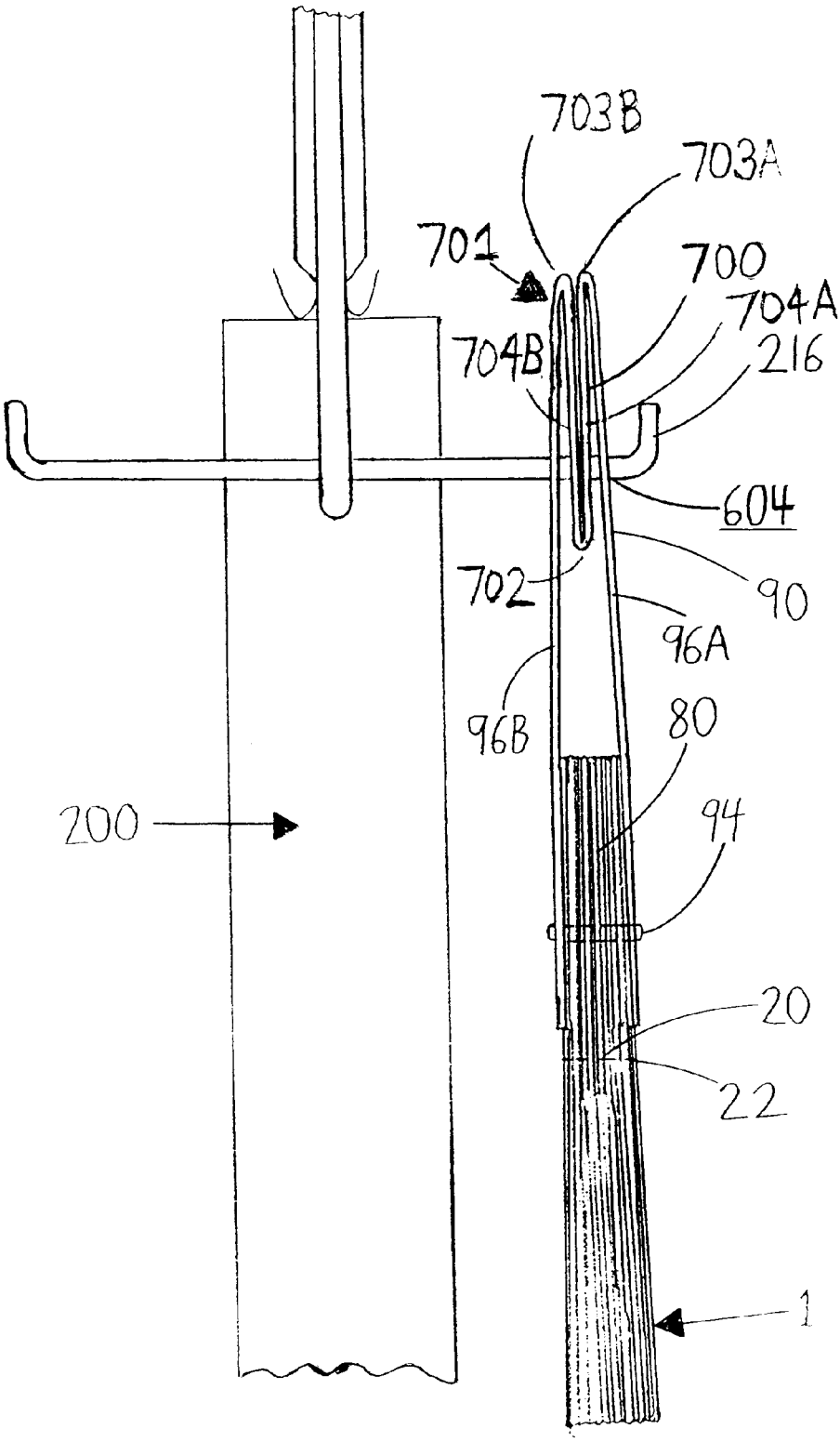
FIG. 8 is a side view of one preferred embodiment of the display stand of FIG. 3, illustrating a side view of an upper portion of a stack of disposable rain hoods and details of how the reinforced receptacle holder may be suspended from the display stand.

A means 705 is provided for fixedly attaching the opposing flaps 704A, 704B of the reinforcement member 700 to each other. In FIGS. 7 and 8, the means comprises an adhesive substance 705, which is economical and contributes to the ease of manufacture. Other means of fixedly attaching the opposing flaps 704A, 704B of the reinforcement member 700, such as staples or thread and the like could also be used.

Figure 13:
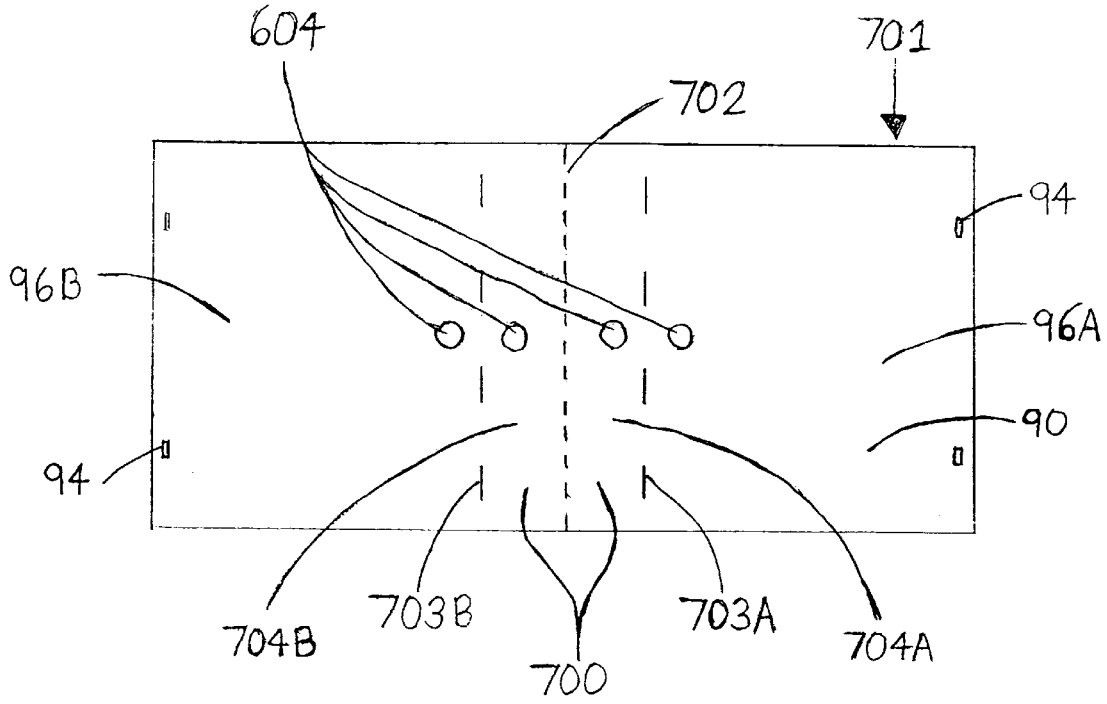
FIG. 13 is a top-view of one preferred embodiment of the present invention prior to folding.

FIG. 13 shows the preferred embodiment prior to forming the opposing flaps 704A, 704B of the reinforced member 700 and the opposing flaps 96A, 96B of the display holder 90 from a single piece of cardboard. The opposing flaps 704A, 704B are formed by upwardly folding the display holder 90 along the upward fold 702. The upward fold is preferable perforated. In a preferred embodiment, the perforations of upward fold 702 are about 0.125 inches (about 0.3 cm) in length and are spaced to obtain about four perforations per inch. The opposing flaps 96A, 96B of the display holder 90 are formed by downwardly folding the display holder 90 along the downward folds 703A, 703B. Folds 703A, 703B run substantially parallel to the upward fold 702. Folds 703A, 703B are preferably perforated. In a preferred embodiment, the perforations of downward folds 703A, 703B are about 0.5 to 0.75 inches (1.2 to 1.9 cm) in length and are spaced about 0.875 to 1.125 inches (2.2 to 2.9 cm) apart.

As shown in FIGS. 6 and 8, the display holder 90 and reinforcement member 700 have at least one aperture 604 that passes through both of the opposing flaps 704A, 704B of the reinforcement member 700 and the opposing flaps 96A, 96B of the display holder 90. The aperture 604 is sized to receive the bracket member 216 of the display stand 200 to thereby permit the reinforced display holder 701 to be suspended from the display stand 200.

Figure 14:
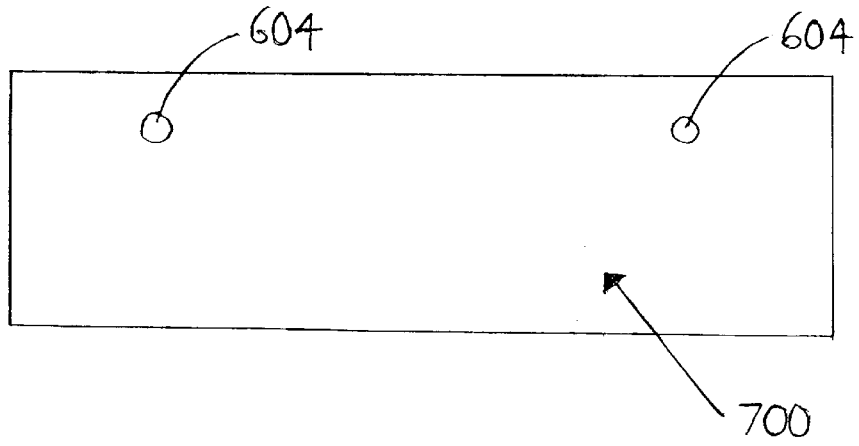
FIG. 14 is a side-view of one preferred embodiment of FIG. 13 after folding.

FIG. 14 shows an alternative embodiment of a reinforced holder 700 that is designed particularly for use with disposable rain hoods 1. The embodiment of FIG. 14 has two apertures 604, 604, such that the reinforcement member 700 can be used with the two-aperture display holder 90 shown in FIGS. 3 and 12.

Figure 10:
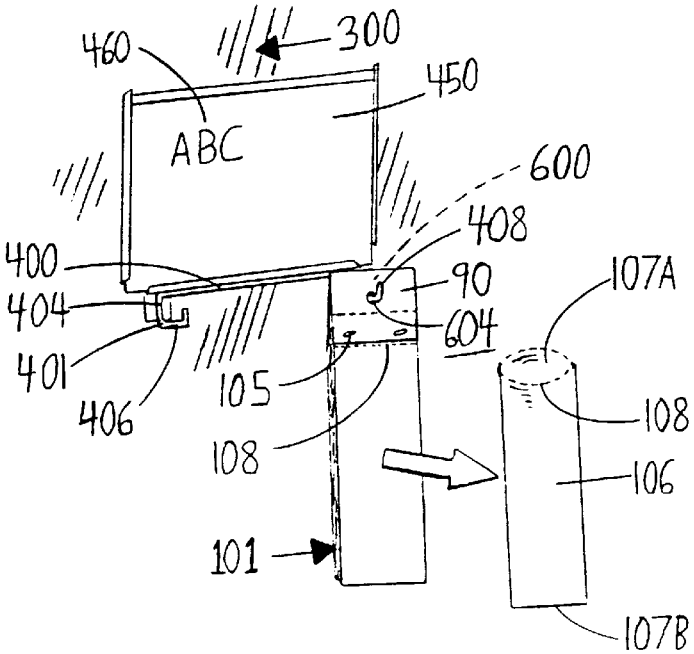
FIG. 10 is a frontal perspective view of one preferred embodiment of the wall mounted display stand of FIG. 9, showing the stand mounted on a wall, and showing a plurality of receptacles for umbrellas suspended from the stand.

As mentioned above, a plurality of disposable rain protection devices 1, 106 are removably attached to a lower portion 91 of the display holder 90. As shown in FIGS. 8 and 10, the reinforced display holder 701 of the invention is used to display and dispense disposable rain protection devices 1, 106 by hanging or suspending such devices 1, 106 from a bracket member 216, 400. FIG. 10 shows a set or stack arrangement 101 of disposable receptacles for umbrellas 106 suspended from a wall mounted display stand bracket member 400. FIG. 8 shows a set or stack arrangement 4 of disposable rain hoods 1 suspended from the bracket member 216. Details of each of these disposable rain protection devices 1, 106 will now be described.

In FIGS. 6 and 10, the disposable rain protection devices suspended from the display holder 90 are disposable receptacles for umbrellas 106. The receptacles are shown stacked together in a set 101. As shown most clearly in FIG. 10, each disposable receptacle for umbrellas 106 comprises an elongated bag having an open end 107A for receiving a wet umbrella and a closed end 107B for preventing water from the wet umbrella from leaking from the receptacle. A set of large sized receptacles can be provided for large umbrellas, and a set of small sized receptacles can be provided for small umbrellas. As shown in FIG. 6, each disposable receptacle for umbrellas 106 is preferably attached to the display holder via a suspension portion 80. The suspension portion 80 is detachably connected to the open end 107A of the elongated bag 106 by a frangible perforation 108, such that a selected disposable receptacle 106 may be selectively detached from the suspension portion 80 and the display holder by pulling the disposable receptacle 106 relative to the display holder to thereby break the frangible perforation 108.

Figure 1:
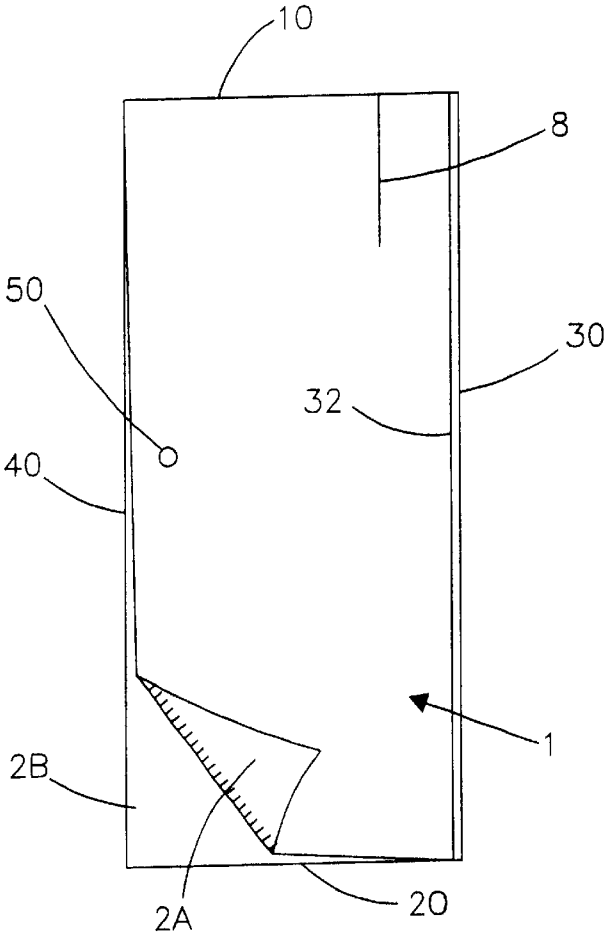
FIG. 1 is a side view of one preferred embodiment of the disposable rain hood of the invention.

FIG. 1 shows a side view of a preferred embodiment of a disposable rain hood 1, which is presently the subject of the inventor's pending U.S. patent application Ser. No. 09/484,104. As described below, the disposable rain hood 1 can be readily incorporated into the present invention. The rain hood comprises, generally, a pair of opposing flaps 2A, 2B, the flaps being composed of conventional plastic sheeting or other inexpensive rain impermeable material. In FIG. 1, flap 2A is shown partially folded back at a front-lower corner. The flaps 2A, 2B are attached to one another substantially along respective upper edges 10 thereof. The flaps 2A, 2B are further attached to one another substantially along respective rear edges 30 thereof. The upper 10 and rear 30 edge attachments provide a rain-impermeable barrier along the upper 10 and the rear 30 edges of the disposable rain hood. With the flaps 2A, 2B scaled together in the foregoing manner, the disposable rain hood 1 has a substantially open front edge 40 and a substantially open lower edge 20. The open front 40 and lower edges 20 permit the disposable rain hood 1 to receive a head and torso of a user 100, as shown most clearly in FIG. 2.

The pair of flaps 2A, 2B are preferably formed from a single lengthwise sheet of plastic. In the preferred embodiment shown in FIG. 1, the sheet is folded substantially along a width-wise centerline 10 thereof to thereby form the pair of lengthwise opposing flaps 2A, 2B. The sheet is preferably about 37 by 30 inches (94 by 76 cm) prior to folding, which forms an approximately 37 by 15 inch (94 by 38 cm) hood after folding. The fold 10 forms the upper edge 10 of the disposable rain hood 1, and the rear edge attachment 30 is preferably formed by heat sealing the rear edges 30 of the flaps to one another. Such heat sealing methods are well known to those of ordinary skill in the art, but as far as is known such heat sealing methods have not been applied to disposable rain hoods as described herein. FIG. 1 shows an example of a heat seal 32 sealing rear edge 30. In another embodiment, the sheet is folded substantially along a lengthwise centerline 30 thereof to thereby form the pair of lengthwise opposing flaps 2A, 2B. In this embodiment, the fold 30 forms the rear edge 30 of the disposable rain hood, and the upper edge attachment 10 is formed by heat sealing the upper edges 10 of the flaps 2A, 2B to one another. Alternatively, the disposable rain hood 1 can be formed from a pair of lengthwise sheets 2A, 2B, the two sheets being sealed together, preferably by heat sealing, to form the upper 10 and rear 30 edge attachments.

Figure 2:
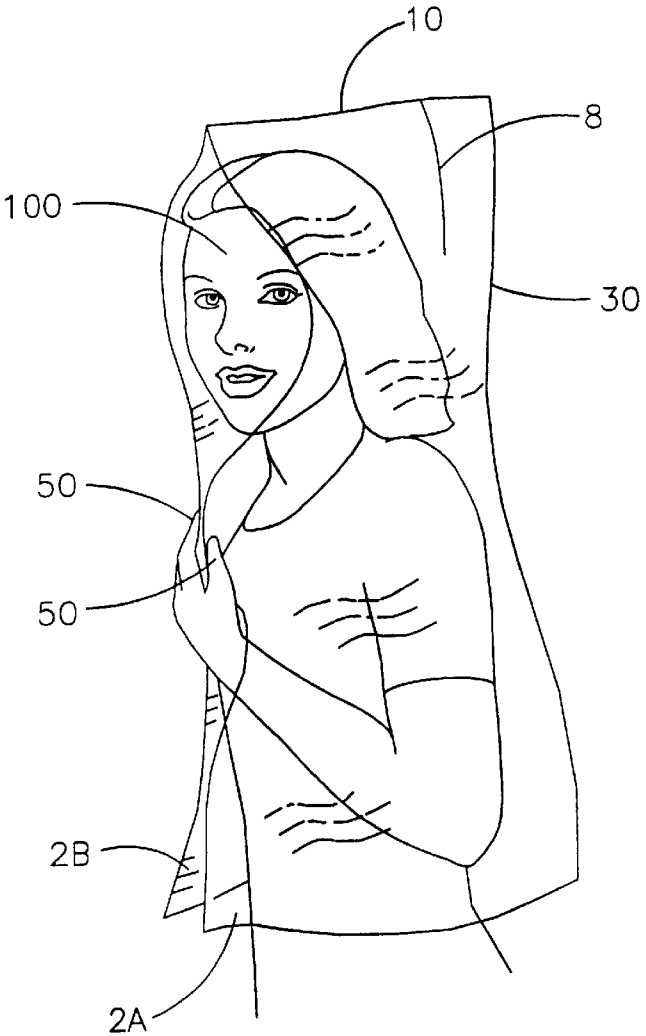
FIG. 2 is a perspective front-side view of one preferred embodiment of the disposable rain hood of the invention as shown in FIG. 1 illustrating the disposable rain hood covering the head and torso of a user.

As shown most clearly in FIG. 2, the disposable rain hood 1 is preferably further provided with a head stop 8. The head stop 8 serves to properly position the head of a user 100 in the disposable rain hood 1. The head stop 8 further attaches the respective flaps 2A, 2B to one another. The head stop 8 extends downward substantially from the sealed upper edge 10 of the disposable hood and extends substantially parallel to an upper portion of the sealed rear edge 30. The head stop 8 is positioned a sufficient distance from the open front edge 40 of the disposable rain hood 1 to thereby permit the head stop 8 to function as a rear barrier for a back portion of the head of the user 100 while the rain hood simultaneously shields the head of the user 100 from rain. The head stop 8 is preferably formed by heat sealing the flaps 2A, 2B to one another along the desired position of the head stop 8. Alternatively, stapling, stitching, or the like could be used to form the head stop 8.

The disposable rain hood 1 is also preferably provided with at least one hole 50 positioned substantially along the forward edge 40 of each of the flaps 2A, 2B. The holes 50 are positioned to permit the forward edges 40 of the disposable rain hood to be selectively held together either by fingers of the user 100 or by a tie (e.g. string or a twist-tie) passing through the holes (the tie taking the place of fingers) to thereby secure the hood on the user, as shown in FIG. 2. This feature is designed particularly for windy conditions, where a light-weight disposable rain hood 1 could be blown off of a user 100 by a gust of wind. Although only one pair of holes 50 is shown in the drawings, additional holes 50 can be provided along the open edge 40 to thereby accommodate different sizes and preferences of users 100.

Figure 4:
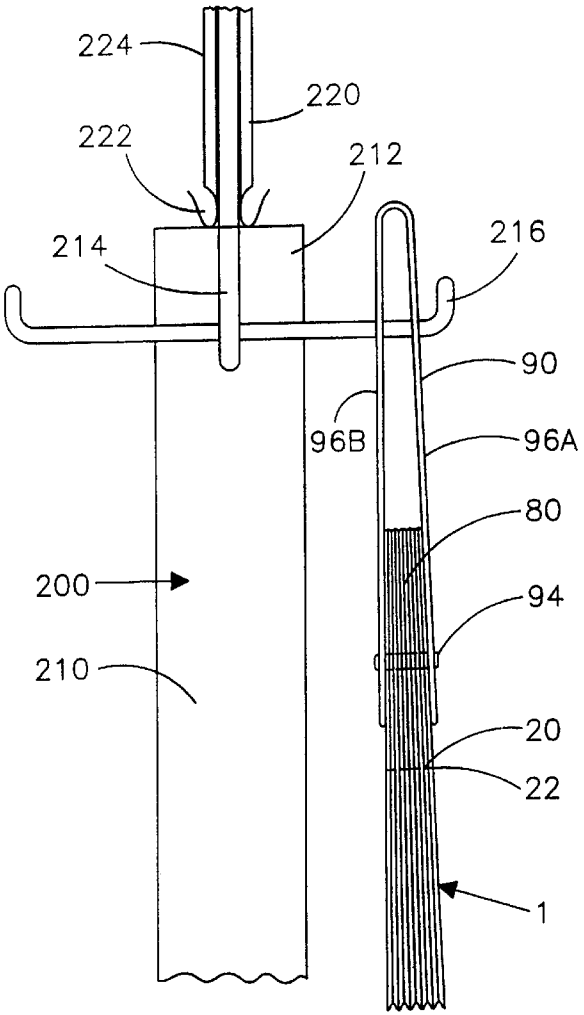
FIG. 4 is a partial side-view of the display stand of FIG. 3, illustrating a side view of an upper portion of a stack of disposable rain hoods and details of how the stack of rain hoods may be suspended from the display stand.
Figure 3:
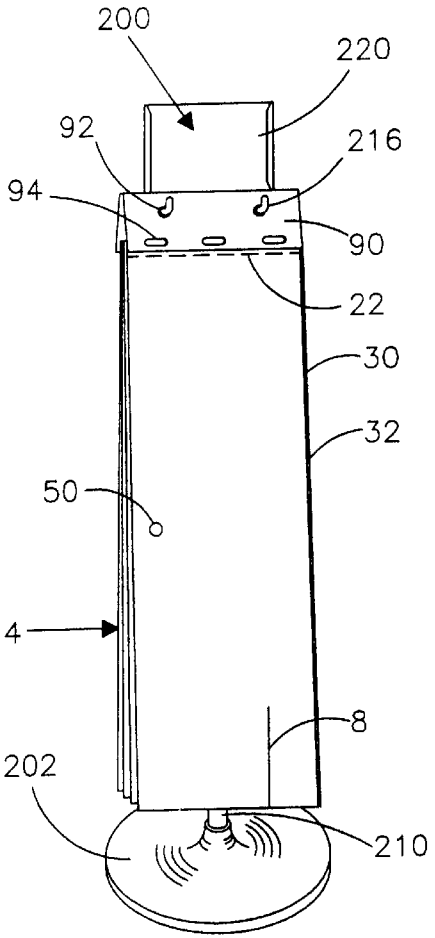
FIG. 3 is a perspective view of one preferred embodiment of the invention, showing a plurality of disposable rain hoods stacked together and suspended from a display stand.

FIGS. 3 and 4 show a stack arrangement 4 of a plurality of disposable rain hoods 1, in which each of the hoods 1 has a suspension portion 80 extending from the lower edges 20 of the flaps 2A, 2B. The suspension portion 80 is detachably connected to the lower edge 20 of the flaps 2A, 2B by a frangible perforation 22. The stack 4 is provided with a display holder 90. The stack 4 of disposable hoods 1 is fixedly attached to the display holder 90 via the suspension portions 80 such that a selected disposable rain hood 1 may be selectively detached from the suspension portion 80 by pulling the disposable hood 1 relative to the holder 90 to thereby break the frangible perforation 22. The display holder 90 is folded over a plurality of the suspension portions 80. Opposing flaps 96A, 96B of the display holder 80 are attached to one another by a plurality of staples 94 passing through the plurality of suspension portions 80. In a preferred embodiment, the stack is originally provided with about 30–35 hoods, which provides a sufficient number of hoods for most applications, such as supplying heavy demand during a sudden rain shower, while avoiding an unduly bulky stack of disposable rain hoods 1 on the display stand 200.

FIGS. 3 and 4 show a preferred embodiment of the disposable rain hood 1 displayed on a display stand 200. Such stands are distributed by Custom Specialties & Supply, Inc. of Metairie, La. Heretofore, such stands have been used for the display and dispensing of bags for holding wet umbrellas. As shown in FIGS. 3 and 4, such display stands 200 comprise a base 202 for supporting the stand, a pole 210 extending substantially vertically upward from the base 202, and a pair of display prongs 216 positioned adjacent an upper end 212 of the pole 210. The display stand 200 is also preferably provided with a sign holder 220 on the upper end 212 of the pole 210. In the embodiment shown most clearly in FIG. 4, the sign holder 220 consists of a pair of parallel plates 220 having an inwardly turned lower edge 222 and inwardly turned side edges 224, the inwardly turned edges providing a means for holding a sign insert. The sign insert can contain writing informing passers-by about the disposable rain protection devices 1, 106 and/or can be provided with advertising information.

Figure 5:
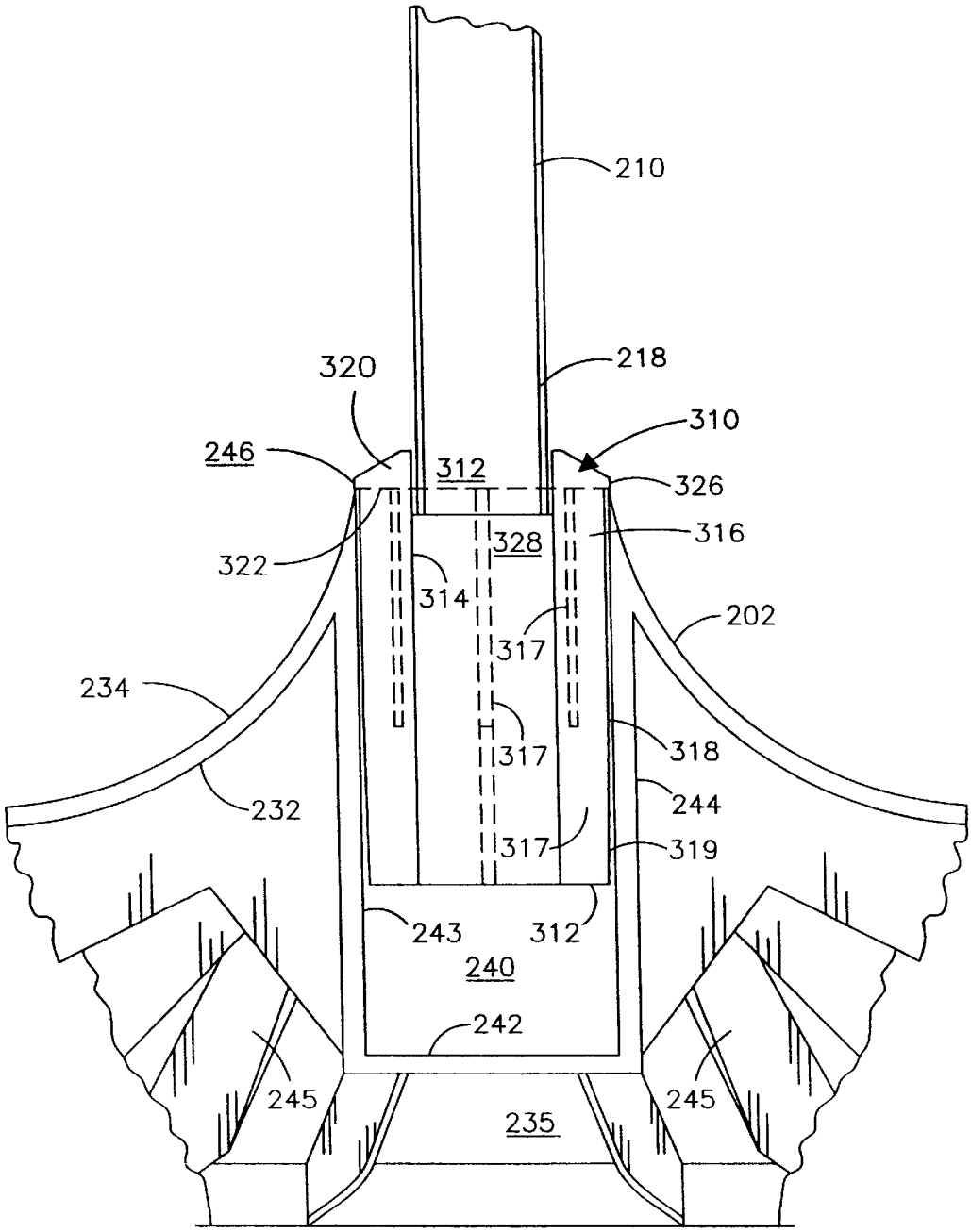
FIG. 5 is a cross-sectional side view of a preferred embodiment of a base of the display stand of FIG. 3, illustrating internal features of the base.

Although numerous designs and configurations can be used for the display stand 200, FIG. 5 shows a design for a base 202 for the display stand 200 that has been useful for displaying disposable rain protection devices 1, 106. The base 202 shown in FIG. 5 has a generally cylindrical opening 240 that extends substantially vertically into the base 202. Any of a number of configurations could be used for the base 202, provided that the base is light in weight (light weight being preferable to facilitate movement, repositioning, shipping and storage of the display stand 200) and is capable of maintaining the cylindrical opening 240, insert 310, and pole 210 in a substantially vertical orientation. The configuration of the base 202 shown in FIGS. 3 and 5 is a modified flattened cone which is circular when viewed from above. This configuration provides a solid base, minimizes the volume required for the base, and is esthetically pleasing. In the embodiment of the base 202 shown in FIG. 5, the vertical generally cylindrical wall 243 of the opening 240 is contiguous with the base 202. In this embodiment, the upper end 246 of the opening 240 forms a support for the insert 310 on the outer surface 234 of the base 202, as will be described in further detail below. Other support means could be provided, however, such as sizing the insert 310 and opening 240 such that the lower end 312 of the insert 310 rests on a closed bottom end 242 of opening 240.

In order to minimize the weight of the base 202, the base 202 shown in FIG. 5 has a substantially hollow interior 235. In order to provide additional support to the base 202, particularly in view of the minimization of weight and materials used in forming the base, it is preferable to provide the interior 235 of the base 202 with a plurality of support ribs 245. The support ribs 245 preferably extend radially outward from the base opening 240. In a preferred embodiment, the support ribs 245 are contiguous with the exterior surface 244 of the opening 240. Additionally, in a preferred embodiment, upper edges of the support ribs 245 are contiguous with an interior surface 232 of the base 202.

The insert 310 is positioned in the generally cylindrical opening 240 of the base 202. The insert 310 is preferably detachably engaged within the cylindrical opening 240 of the base, but it can alternatively be fixedly attached to the opening 240. As shown in FIG. 5, the insert 310 comprises a generally cylindrical body 316. The body 316 has a generally cylindrical opening 328 passing longitudinally through at least an upper end 314 thereof. In the embodiment shown in FIG. 5, the generally cylindrical opening 328 passes entirely through the body 316.

As shown in FIG. 5, a plurality of longitudinal ribs 317 extend radially outward from the body 316. As shown in FIG. 4, the outer longitudinal edges 318 of the ribs 317 are sized to tightly abut against the interior wall 243 of the generally cylindrical opening 240 of the base 202, to thereby maintain the insert 310 in a substantially vertical orientation relative to the base 202. In the preferred embodiment shown in FIG. 5, a portion 319 of each of the ribs 317 of the insert 310 taper toward a lower end 312 of each of the ribs 317. The tapered end 319 of the insert 310 facilitates insertion of the insert 310 into the opening 240 in the base 202.

An end plate 320 is preferably formed on an upper end 314 of the insert 310. The end plate 320 preferably has a diameter greater than the opening 240 in the base 202 to thereby support the insert 310 on the base 202. A lower surface 322 of the end plate 320 is preferably contiguous with upper ends of the ribs 317. As shown most clearly in FIG. 5, an outer portion 326 of the end plate 320 extends beyond the edges 318 of the ribs 317, providing a support 326 for supporting the insert 310 on the upper end 246 of the opening 240 of the base 202.

The pole 210 is sized to tightly fit within the opening of the insert 310. A lower end 218 of the pole 210 is positioned in the opening 328 in the upper portion 312 of the insert 310. With the insert 310 positioned in the opening 240 of the base 202, the pole 210 extends substantially vertically upward from the base 202. As indicated in FIG. 5, when the circumference of the pole 210 is properly sized relative to the circumference of the insert opening 328, the lower end 218 of the pole 210 may be inserted only a relatively short distance into the upper portion 312 of the insert opening 328, yet still maintain the pole 210 in a substantially vertical orientation.

Figure 9:
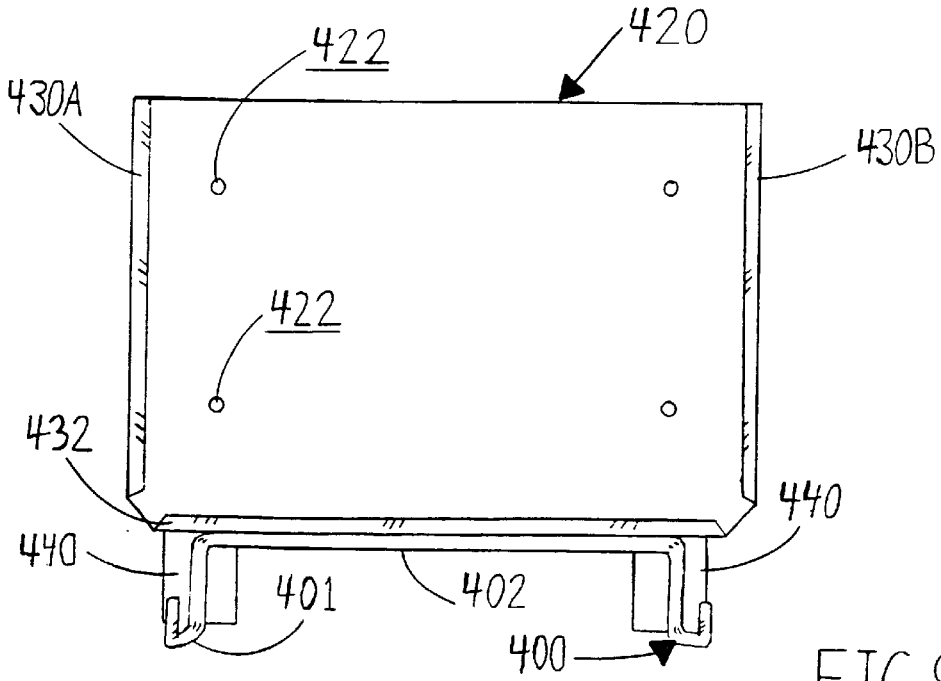
FIG. 9 is a front view of one preferred embodiment of a wall mounted display stand for displaying embodiments of the invention.

FIGS. 9–12 show a wall mounted display stand which is presently the subject of the inventor's pending U.S. patent application Ser. No. 09/495,086. The wall mounted stand of FIGS. 9 and 10 can be used with the reinforced display holder of the present invention, and is fully interchangeable with the preferred embodiment of a display stand shown in FIGS. 3–5. As shown in FIG. 9, the wall mounted apparatus for displaying and dispensing disposable rain protection devices of the invention comprises, generally, a bracket member 400 and a means, e.g. 420, 422 for mounting the bracket member on a wall. The bracket member 400 is configured to hold disposable rain protection devices 1, 106 (see FIGS. 2–4) when the bracket member 400 is mounted on a wall 300. The basic concept of the invention is to provide a stand for displaying and dispensing disposable rain protection devices that can be mounted on existing structures in a building or the like, thereby eliminating the need to provide a structure, such as a base and vertical pole, for displaying such items. As such, the term "wall" as used herein means conventional walls of buildings, including both inside and outside walls. Additionally, the term "wall" as used herein also includes other generally fixed structures of buildings, such as vertical or horizontal beams, walls of counters, shelves, doors, and the like.

As shown in FIGS. 9–12, the apparatus is preferably provided with a sign holder 420. In a preferred embodiment, the sign holder 420 comprises a plate and a plurality of frame members 430A, 430B, 432. The frame members 430A, 430B, 432 are positioned substantially along opposing side edges and a lower edge of the plate, and are configured to retain a sign in the sign holder 420. In the preferred embodiment shown in FIGS. 1–4, the sign holder 420 consists of a substantially rectangular plate 420. Three side edges 430A, 430B, 432 of the plate 420 are turned inward toward a front surface of the plate. The inwardly turned sides 430A, 430B, 432 define grooves for receiving and retaining a sign in the sign holder 420. A sign 450 can be removably mounted in the sign holder 420 by sliding the sign 450 into the grooves 430A, 430B, 432. The sign 450 may provide writing, logos, or other indicia 460 related to advertising or providing information, including advertising or information about the disposable rain protection devices 1, 106 on the stand.

Figure 11:
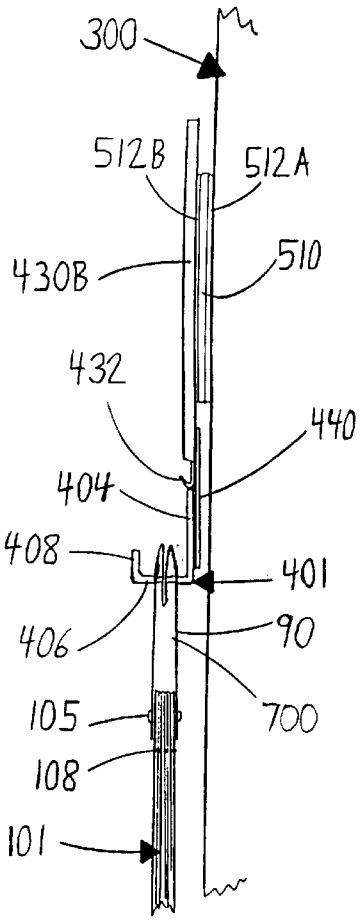
FIG. 11 is a side-view of the wall mounted display stand of FIG. 10 and the reinforced holder of the present invention, illustrating the stand mounted on a wall by adhesive means, such as double sided tape.

As shown most clearly in FIG. 11, the bracket member 400 preferably comprises at least one hook 401. In the embodiment shown in FIG. 11, a support portion 404 of the hook 401 extends from the sign holder 420. The support portion 404 preferably extends downward or sideward from the sign holder 420, such that items suspended from the hook 401 will not obscure the surface of the sign holder 420 or sign 450. A suspension portion 406 of the hook 401 is positioned to extend outward from the wall 300 and the sign holder 420 when the device is mounted on the wall 300, to thereby permit the suspension portion 406 to hold the disposable rain protection devices 1, 106 for display and dispensing. In the preferred embodiment shown most clearly in FIG. 11, the hook 401 is configured as a substantially vertical downwardly depending support portion 404, a suspension portion 406 extending substantially perpendicularly from a lower end of the support portion 404, and the suspension portion 406 having an upwardly turned prong 408 for securing disposable rain protection devices 1, 106 on the hook 401.

In the preferred embodiment shown in FIGS. 9–12, the bracket member 400 has two of the hooks 401. The bracket member also preferably further comprises an elongated bar 402. The elongated bar 402 is preferably fixedly positioned substantially along a lower edge 232 of the sign holder 420. An upper end of the support portion 404 of each hook 401 is preferably fixedly positioned on either end of the elongated bar 402. This particular embodiment can be formed from a single piece of heavy steel wire (e.g. 0.5 cm diameter wire).

In a preferred embodiment shown most clearly in FIGS. 2–3, each hook 401 is preferably further braced relative to the sign holder 420 by a brace member 440. In a preferred embodiment, the brace member 440 extends downward from the sign holder 420 along the support portion 404 of the hook 401, and the support portion 404 of the hook 401 is fixedly connected to the brace member 440, such as by welding. The brace member 440 may be a small sheet of metal welded to the back of the sign holder, as shown most clearly in FIG. 11.

Figure 12:
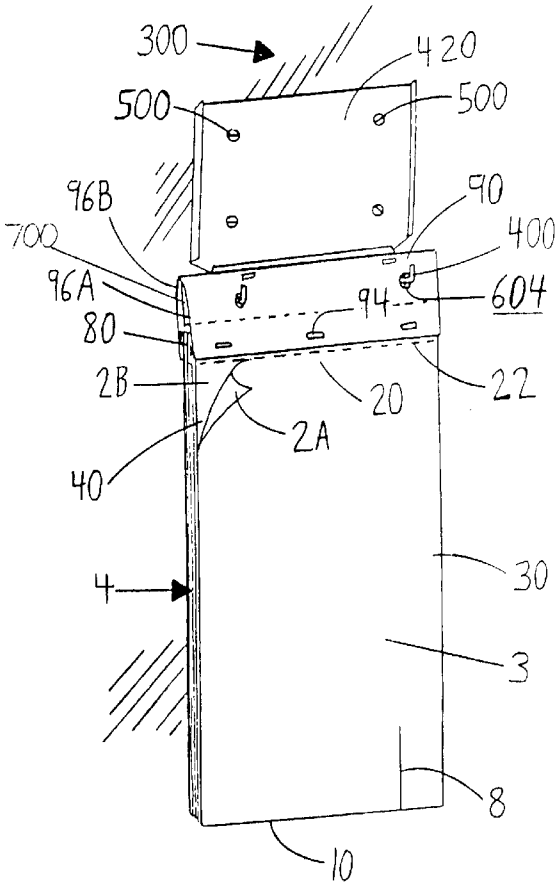
FIG. 12 is a frontal perspective view of one preferred embodiment of a wall mounted display stand, showing the stand mounted on a wall, and showing a plurality of disposable rain hoods suspended from the stand via the reinforced display holder of the invention.

Various means can be used for mounting the wall mounted display stand 400 on a wall 300. FIG. 9 shows a plurality of holes 422 through the sign holder 420. FIG. 12 shows a screw, bolt, nail, or the like 500 inserted through a hole 422 and into the wall 300 to thereby secure the apparatus 1 on the wall 300. FIG. 11 shows the use of adhesive tape 510, the tape 510 preferably having adhesive 512A, 512B on either side, as a mounting means. Alternatively, hooks could be provided on the wall 300 for latching onto hooks, eyelets, or a picture wire positioned on the back of the sign holder 420, in the conventional manner of hanging pictures or other wall mounted items.

The various components of the wall mounted sign can be constructed of conventional rigid and generally durable materials, such as metal, plastic, or wood. Steel provides a durable bracket and sign holder that can be economically manufactured using conventional bending, shaping, and welding techniques.

In operation, the disposable rain protection devices 1, 106 are displayed and dispensed from a display stand 200 or wall mounted display stand 400 via the reinforced aperture 604, such that the plurality of disposable rain protection devices 1, 106 depends downward from the reinforced display holder 701. When suspended in this manner, an individual disposable rain protection device 1, 106 may be selectively removed from the display holder 200, 400 by pulling the individual disposable rain protection device 1, 106 downward relative to the bracket 216, 400 to thereby break the frangible connection without tearing the reinforced aperture 604.

The disposable rain hoods 1 can be constructed according to the following methods. A sheet of plastic 1 is cut or provided in a lengthwise format, i.e. a generally rectangular shape (e.g. 30 by 37 inches). The sheet is folded substantially along a centerline (see e.g. 10 or 30) to thereby form the pair of flaps 2A, 2B. The flaps 2A, 2B are then heat sealed together substantially along an edge adjacent to the fold (see e.g 10 or 30). The folding and heat sealing thereby form a sealed upper edge 10 and a sealed rear edge 30, and also thereby leave an open front edge 40 and an open lower edge 20 of the disposable rain hood 1 for receiving a head and torso of a user 100 of the disposable rain hood 1.

A head stop 8 can be formed by heat sealing the flaps 2A, 2B together along a line 8 extending downward substantially from the sealed upper edge 10 of the disposable hood 1 and extending substantially parallel to an upper portion of the sealed rear edge 30, the head stop 8 being positioned a sufficient distance from the open front edge 40 of the disposable rain hood to thereby permit the head stop 8 to function as a rear barrier for a back portion of the head of the user 100 while the hood simultaneously shields the head of the user 100 from rain.

At least one hole 50 can be punched in each of the flaps 2A, 2B, preferably substantially along the forward edge 40, the holes 50 being positioned to permit the forward edges 40 of the disposable rain hood 1 to be selectively held together either by fingers of the user 100 or by a tie passing through the holes 50 to thereby secure the hood 1 on the user 100, as shown most clearly in FIG. 2.

The suspension portion 80 can be formed below the lower edge 20 by punching a frangible perforation 22 substantially along and adjacent the lower edge 20 of the flaps 2A, 2B, thereby leaving a desired length for the suspension portion 80.

Preparation of a stack 4 of disposable rain hoods is accomplished by first constructing a plurality of the disposable rain hoods 1. The plurality of disposable rain hoods 1 are then stacked together such that the suspension portions 80 are stacked atop one another and such that the upper edges 10 are stacked atop one another, as shown in FIGS. 3 and 4. A reinforced display holder 700 is then stapled or otherwise attached to the suspension portions 80, such that the plurality of disposable rain hoods 1 are held together at the suspension portions 80, such that the stack 4 may be suspended from a display stand 200 by the aperture 604 on the display holder 90, and such that a selected disposable rain hood 1 may be selectively detached from the suspension portion 80 by pulling the selected disposable hood 1 relative to the display holder 90 to thereby break the frangible perforation 22.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A stacked assembly of disposable rain protection devices having a reinforced holder for displaying and dispensing the disposable rain protection devices from a bracket member of a display stand, comprising:

a plurality of disposable rain protection devices, each said rain protection device having a suspension portion extending from an edge of said rain protection device, said suspension portion detachably connected to said edge by a frangible perforation, said plurality of said disposable rain protection devices stacked together such that said suspension portions are adjacent one another, a display holder formed from a piece of cardboard, said piece of cardboard folded upward along an upward fold and downward along a pair of downward folds to thereby form a pair of opposing display holder flaps and an integral reinforcement member comprising a pair of opposing reinforcement member flaps, said opposing reinforcement member flaps sandwiched between said opposing display holder flaps and depending downward from an upper portion of said opposing display holder flaps, said opposing reinforcement members flaps fixedly attached to one another, said suspension portions of said stack of disposable rain protection devices sandwiched between a lower portion of said opposing display holder flaps of said display holder, said display holder flaps attached to one another by a fastening means passing through said plurality of suspension portions such that a selected disposable rain protection device may be selectively detached from said suspension portion by pulling said disposable rain protection device relative to said holder to thereby break said frangible perforation, and said display holder and said reinforcement member having at least one aperture passing through both said reinforcement member and said opposing flaps of said display holder, said at least one aperture sized to receive said bracket member of the display stand to thereby permit said disposable rain protection devices to be suspended from the display stand via said display holder.

2. The assembly of claim 1, wherein said piece of cardboard is rectangular.

3. The assembly of claim 1, further comprising a perforated line along said upward fold and a perforated line along each of said downward folds, said perforated lines assisting in forming said reinforcement member.

4. The assembly of claim 3, wherein said perforated line along said upward fold is formed from a plurality of perforations of about 0.125 inches in length, said perforations spaced along said upward fold at about four perforations per inch.

5. The assembly of claim 3, wherein said perforated line along each of said downward folds is formed from a plurality of perforations of between about 0.5 to 0.75 inches in length, said perforations spaced between about 0.875 to 1.125 inches apart.

6. The apparatus of claim 1, wherein said plurality of disposable rain protection devices are disposable receptacles for umbrellas, each said disposable receptacle for umbrellas comprising an elongated bag having an open end for receiving a wet umbrella and a closed end for preventing water from said wet umbrella from leaking from said receptacle.

7. The apparatus of claim 3, wherein each said disposable receptacle for umbrellas is attached to said display holder via a suspension portion, said suspension portion detachably connected to said open end of said elongated bag by a frangible perforation, such that a selected disposable receptacle may be selectively detached from said suspension portion and said display holder by pulling said disposable receptacle relative to said display holder to thereby break said frangible perforation.

8. The apparatus of claim 1, wherein said plurality of disposable rain protection devices are disposable rain hoods, each said disposable rain hood comprising a pair of opposing flaps, said opposing rain hood flaps attached to one another substantially along respective upper edges thereof, said opposing rain hood flaps further attached to one another substantially along respective rear edges thereof, said upper and rear edge attachments providing a rain-impermeable barrier along said upper and said rear edges of said disposable rain hood, and said disposable rain hood having a substantially open front edge and a substantially open lower edge for receiving a head and torso of a user of said disposable rain hood.

9. The apparatus of claim 8, further comprising each said disposable rain hood having a head stop further attaching said respective opposing rain hood flaps to one another, said head stop extending downward substantially from said sealed upper edge of said disposable hood and extending substantially parallel to an upper portion of said sealed rear edge, said head stop being positioned a sufficient distance from said open front edge of said disposable rain hood to thereby permit said head stop to function as a rear barrier for a back portion of said head of said user while said hood simultaneously shields said head of said user from rain.

10. The apparatus of claim 8, further comprising each of said flaps of said disposable rain hood having at least one hole positioned substantially along said forward edge, said holes positioned to permit said forward edges of said disposable rain hood to be selectively held together either by fingers of said user or by a tie passing through said holes to thereby secure said hood on said user.

11. The apparatus of claim 8, wherein each said disposable rain hood is attached to said display holder via a suspension portion, said suspension portion detachably connected to said lower edge of said flaps of said disposable rain hood by a frangible perforation, such that a selected disposable rain hood may be selectively detached from said suspension portion and said display holder by pulling said disposable hood relative to said display holder to thereby break said frangible perforation.

12. A method of displaying and dispensing disposable rain protection devices comprising:

providing a display stand having a bracket member;

providing a plurality of disposable rain protection devices removably attached to a lower portion of a reinforced display holder;

said reinforced display holder comprising:

a display holder formed from a piece of cardboard, said piece of cardboard folded upward along an upward fold and downward along a pair of downward folds to thereby form (a) a pair of opposing display holder flaps and (b) an integral reinforcement member comprising a pair of opposing reinforcement member flaps, said opposing reinforcement member flaps sandwiched between said opposing display holder flaps and depending downward from an upper portion of said opposing display holder flaps, said opposing reinforcement members flaps fixedly attached to one another, said suspension portions of said stack of disposable rain protection devices sandwiched between a lower portion of said opposing display holder flaps of said display holder, said display holder flaps attached to one another by a fastening means passing through said plurality of suspension portions such that a selected disposable rain protection device may be selectively detached from said suspension portion by pulling said disposable rain protection device relative to said holder to thereby break said frangible perforation, and said display holder and said reinforcement member having at least one aperture passing through both said reinforcement member and said opposing flaps of said display holder, said at least one aperture sized to receive said bracket member of the display stand to thereby permit said disposable rain protection devices to be suspended from the display stand via said display holder; and suspending said reinforced display holder on said bracket member via said aperture such that individual disposable rain protection devices may be selectively removed from said display holder.

13. The method of claim 12, wherein said display holder further comprises a perforated line along said upward fold and a perforated line along each of said downward folds, said perforated lines assisting in forming said reinforcement member.

14. The method of claim 13, wherein said perforated line along said upward fold is formed from a plurality of perforations of about 0.125 inches in length, said perforations spaced along said upward fold at about four perforations per inch.

15. The method of claim 13, wherein said perforated line along each of said downward folds is formed from a plurality of perforations of between about 0.5 to 0.75 inches in length, said perforations spaced between about 0.875 to 1.125 inches apart.

16. The method of claim 12, wherein said plurality of disposable rain protection devices are disposable receptacles for umbrellas, each said disposable receptacle for umbrellas comprising an elongated bag having an open end for receiving a wet umbrella and a closed end for preventing water from said wet umbrella from leaking from said receptacle.

17. The method of claim 16, wherein each said disposable receptacle for umbrellas is attached to said display holder via a suspension portion, said suspension portion detachably connected to said open end of said elongated bag by a frangible perforation, such that a selected disposable receptacle may be selectively detached from said suspension portion and said display holder by pulling said disposable receptacle relative to said display holder to thereby break said frangible perforation.

18. The method of claim 12, wherein said plurality of disposable rain protection devices are disposable rain hoods, each said disposable rain hood comprising a pair of opposing flaps, said opposing rain hood flaps attached to one another substantially along respective upper edges thereof, said opposing rain hood flaps further attached to one another substantially along respective rear edges thereof, said upper and rear edge attachments providing a rain-impermeable barrier along said upper and said rear edges of said disposable rain hood, and said disposable rain hood having a substantially open front edge and a substantially open lower edge for receiving a head and torso of a user of said disposable rain hood.

19. The method of claim 18, further comprising each said disposable rain hood having a head stop further attaching said respective opposing rain hood flaps to one another, said head stop extending downward substantially from said sealed upper edge of said disposable hood and extending substantially parallel to an upper portion of said sealed rear edge, said head stop being positioned a sufficient distance from said open front edge of said disposable rain hood to thereby permit said head stop to function as a rear barrier for a back portion of said head of said user while said hood simultaneously shields said head of said user from rain.

20. The method of claim 18, further comprising each of said flaps of said disposable rain hood having at least one hole positioned substantially along said forward edge, said holes positioned to permit said forward edges of said disposable rain hood to be selectively held together either by fingers of said user or by a tie passing through said holes to thereby secure said hood on said user.

21. The method of claim 18, wherein each said disposable rain hood is attached to said display holder via a suspension portion, said suspension portion detachably connected to said lower edge of said flaps of said disposable rain hood by a frangible perforation, such that a selected disposable rain hood may be selectively detached from said suspension portion and said display holder by pulling said disposable hood relative to said display holder to thereby break said frangible perforation.

* * * * *